US006615843B2

(12) United States Patent
Pera

(10) Patent No.: US 6,615,843 B2
(45) Date of Patent: Sep. 9, 2003

(54) TOBACCO SMOKE FILTER AND RELATIVE COMPOSITION MADE OF ANTIOXIDANT AND MINERAL SUBSTANCES

(76) Inventor: Ivo E. Pera, 1400 St. Charles Pl., Pembroke Pines, FL (US) 33026

( * ) Notice: Subject to any disclaimer, the term of this patent is extended or adjusted under 35 U.S.C. 154(b) by 0 days.

(21) Appl. No.: 10/085,806

(22) Filed: Feb. 28, 2002

(65) Prior Publication Data

US 2002/0148478 A1 Oct. 17, 2002

(30) Foreign Application Priority Data

Mar. 1, 2001 (EP) ..... 01125053

(51) Int. Cl.[7] ..... A24D 3/04; A24D 3/06

(52) U.S. Cl. ..... 131/341; 131/344; 131/345

(58) Field of Search ..... 131/200, 201, 131/202, 203, 204, 205, 207, 211, 331, 334, 341, 342, 344, 345

(56) References Cited

U.S. PATENT DOCUMENTS

| | | | | | |
|---|---|---|---|---|---|
| 1,743,698 | A | * | 1/1930 | Walker | 131/331 |
| 3,066,681 | A | * | 12/1962 | Cohn | 131/341 |
| 3,079,926 | A | * | 3/1963 | Litchfield et al. | 131/339 |
| 3,251,365 | A | * | 5/1966 | Keith, II et al. | 131/344 |
| 3,658,069 | A | * | 4/1972 | Wise et al. | 131/342 |
| 4,033,361 | A | * | 7/1977 | Horsewell et al. | 131/334 |
| 4,038,992 | A | * | 8/1977 | Ogasa et al. | 131/342 |
| 4,246,910 | A | * | 1/1981 | Rainer et al. | 131/331 |
| 4,284,089 | A | | 8/1981 | Ray | |
| 4,520,134 | A | | 5/1985 | Rosen | |
| 4,715,387 | A | | 12/1987 | Rose | |
| 4,846,199 | A | | 7/1989 | Rose | |
| 4,887,620 | A | | 12/1989 | Summers | |
| 4,920,989 | A | | 5/1990 | Rose et al. | |
| 4,945,928 | A | | 8/1990 | Rose | |
| 4,953,572 | A | | 9/1990 | Rose et al. | |
| 5,016,652 | A | | 5/1991 | Rose et al. | |
| 5,060,672 | A | | 10/1991 | Irimi et al. | |
| 5,076,294 | A | * | 12/1991 | Kramer | 131/331 |
| 5,364,617 | A | | 11/1994 | Bush et al. | |
| 5,383,478 | A | | 1/1995 | Rose et al. | |
| 5,403,834 | A | | 4/1995 | Malfroy-Camine et al. | |
| 5,462,963 | A | | 10/1995 | Bush et al. | |
| 5,472,002 | A | | 12/1995 | Covarrubias | |
| 5,549,125 | A | * | 8/1996 | White | 131/342 |
| 5,780,489 | A | | 7/1998 | Brooks | |
| 5,829,449 | A | | 11/1998 | Hersh et al. | |
| 5,909,736 | A | * | 6/1999 | Stavridis et al. | 131/331 |
| 5,947,127 | A | * | 9/1999 | Tsugaya et al. | 131/332 |
| 6,257,242 | B1 | * | 7/2001 | Stavridis | 131/344 |
| 2002/0020420 | A1 | * | 2/2002 | Xue et al. | 131/203 |

FOREIGN PATENT DOCUMENTS

| | | | | | |
|---|---|---|---|---|---|
| DE | 4105500 | | * | 6/1992 | A24D/3/08 |
| EP | 1238594 | A | * | 9/2002 | A24D/3/14 |

* cited by examiner

*Primary Examiner*—Steven P. Griffin
*Assistant Examiner*—Carlos Lopez
(74) *Attorney, Agent, or Firm*—Malin, Haley & DiMaggio, P.A.

(57) ABSTRACT

A tobacco smoke filter synergist composition is provided comprised of antioxidants and minerals: the former are effective as free radical scavenger and the latter are capable of reducing the other harmful substances from tobacco smoke. In particular, minerals include the magnetized ferrite, which has great adsorbing capacity. The composition can be disposed within a one or more chambers.

27 Claims, 4 Drawing Sheets

TOBACCO SMOKE FILTER AND RELATIVE COMPOSITION MADE OF ANTIOXIDANT AND MINERAL SUBSTANCES

This application claims the benefit of and priority to European Patent Application No. EP 01125053.7, filed Oct. 22, 2001.

TECHNICAL FIELD

The present invention relates to the technical sector of smoking articles and in particular of tobacco smoke filter and relative compositions to insert in cigarettes, cigars and pipes.

BACKGROUND ART

Accumulated evidence by competent medical authorities indicates that the death rate from disease of the coronary arteries and the death from cancer are much higher among persons with a history of regular cigarette smoking than among persons who did not smoke. Smoke free radicals and contaminants are believed to be the primary agents in cigarette smoke hastening death to coronary artery disease. Attempts have been made to reduce the amount of smoke contaminants and other ingredients in tobacco smoke absorbed by the smoker by causing the smoke to pass through filters, which are either embodied in a filter type cigarette or in a holder for the cigarette, cigars or pipe tobacco. Such filters remove a certain proportion of smoke contaminants and tars from the smoke, but the amount remaining and passing into the smoker's system is still far greater than a safe value and is capable of causing objective damage to the lung and heart lining and other parts of the body.

Cigarette smoking is one of the greatest public health problems in the world. Its adverse effect range from mild physical complaints (bad breath, stained fingers and teeth) to a documented decrease in life span. Smoking is known to be a contributing and perhaps the major factor in various forms of health and blood vessel disease, lung cancer, stroke, emphysema and chronic bronchitis.

Nearly 4000 constituents of tobacco smoke have been identified: many are irritants, toxic gases or carcinogens. These particles are inhaled into the lungs, where they irritate the respiratory passages and increase the production of bronchial mucus, possibly initiating cancer.

It is estimated that in the world ⅓ of all cancer deaths in men are related to smoking. Smoking and smokeless tobacco combine to kill more adults worldwide than any other preventable cause of death, including war, famine and terrorist attacks according to the World Watch Institute. Lung cancer cause more deaths each year than any other type of cancer. The first reports linking lung cancer to cigarette smoking were published over 40 years ago, so there is no way to claim ignorance.

Lung cancer is one of the most difficult cancers to be treated. It is difficult to detect in its early stage, so that it often has a death grip treatment is begun. Only 13 percent of lung-cancer patients live five years or more after diagnosis. Some 85 percent of lung cancer in men is due to smoking; 75 percent of lung cancer in women is due to smoking.

Smoking increases the risk not only of lung cancer but also of cancers of the lip, mouth, throat, larynx, esophagus, bladder, pancreas and kidney. It may be associated with cancer of the stomach and cervix, although not indirect contact with tobacco smoke are affected by the substance that the body adsorbs or metabolizes from tobacco components. The pollutants flow through the blood stream to pancreas, bladder and kidney. Unfortunately most smokers do not usually stop smoking until the onset of ill health.

Free radicals are mentioned often in their role causing cancer, heart disease and aging. Let have a detailed look at free radicals to better understand how they cause such extensive and seemingly unrelated damage.

As we know a free radical is an incomplete molecule. It is a fragment of a molecule that is highly reactive, because its electron arrangement is out of balance. Atoms, molecules and ions are more stable entities because they have more balanced electron arrangements.

The highly reactive free radicals do more damage than that of one molecule to one molecule reaction. Each free radical is capable of destroying an enzyme or protein molecule or destroying an entire cell. However, the damage is much more extensive than that because each free radical usually generates a chain of free radical reactions resulting in thousands of free radicals being released to destroy body components.

This biological magnification occurs for two reasons. The first and most important is the enormous sensitivity of the cell to modification in its heredity apparatus such as its DNA. The chromosomes, which control the reproduction of the cell, are extremely radiation sensitive; the cytoplasm is much less so. Largely, because of the sensitivity of DNA, radiations that destroy only one molecule in one million or ten million in the cell can be lethal.

The second cause of biological magnification is that any polymeric system is sensitive to small chemical changes and many important biomolecules are polymers.

Free radical reactions leading to cell membrane damage can cause cancer, heart disease or accelerated aging. There are five basic types of damage caused by free radicals that accelerate aging.

1. Lipid peroxidation, in which free radicals initiate damage to fat compounds in the body, causing them to turn rancid and release more free radicals.
2. Cross-linking, in which free-radical reactions cause protein and/or DNA to fuse together.
3. Membrane damage, in which free radical reactions destroy the integrity of the cell membrane, which in turn interferes with the cell's ability to bring in nutrients and expel wastes.
4. Lyposome damage, in which free-radical reactions rupture lyosome membranes, these then still into the cell and digest critical cell compounds.
5. Accumulation of the age pigment (lipofuscin), which may interfere with cell chemistry.

The most damaging agents of free radical reactions including the peroxide radical ($0_2$), hydroxyl radical (OH), lipid peroxide radical (L00) and hydrogen peroxide ($H_2O_2$).

The body defends itself against these agents with superoxide dismutase (an enzyme that destroys the superoxide radical), catalase (an enzyme that produces vitamin E (a general antiradical and glutathione peroxidase an enzyme that stops lipid peroxidation and converts hydrogen peroxide to water). Each molecule of glutathione peroxidase contains four atoms of selenium.

Thus selenium is a key component of the body's defense against accelerated aging.

Many studies have confirmed that glutathione peroxidase protects cells from mutagenic peroxides formed from DNA and nucleotides. It also breaks down lipid (fat) peroxides that can contribute to arteriosclerosis. It is also involved in the regulation of carbohydrate metabolism and in the maintenance of the integrity of red blood cells. It protects the membranes of liver-cell mitochondria (the cell's energy factors) from damage by peroxides. Glutathione peroxidase is also involved in the prostaglandin metabolism and in the killing of bacteria by white cells.

There is evidence that free radical production increases with age. Superoxide radicals are produced by the mitochondria (energy factories) of cells. The path of superoxide radicals produced by heart mitochondria was studied and the quantity of radicals produced was measured at different ages. Eighty percent of the radicals diffused into the matrix space where they were trapped by superoxide dismutase.

The remaining 20 percent of the superoxide radicals migrate across the mitochondria membrane into the cytosol (cell interior) where they react with various components of the mitochondrial membrane, such as polyunsaturated fatty acids.

Researchers have found that the age-related increase in the formation of superoxide radicals is accompanied by an increase in the peroxide content of the mitochondria. Therefore, it is concluded that the free radical chain reactions appear to exceed the homeostatic protection of the mitochondria in aging animals.

The free radicals, vapor and particles phase of smoke components of medical importance may be separated as follows:

1. Carcinogens and co-carcinogens are present in the tar. Carcinogens (principally polycyclic aromatic alcohols) initiate cancer formation. Co-carcinogens (including phenols, fatty acids and free fatty acids accelerate the production of cancer by other initiators. Many co-carcinogens are also irritants.
2. Irritants cause immediate coughing and broncho-constriction after smoke inhalation, inhibit cilial action in the bronchial epithelium, stimulate mucous secretion suppress protease inhibition and impair alveolar macrophage function.
3. Nicotine principally affects the nervous system and is probably responsible for a smoker's pharmacological dependence on cigarettes. Nicotine indirectly affects circulation by provoking catecholamine release which causes tachycardia, increased cardiac output, vasoconstriction and increased TB. Nicotine also increased serum free fatty acids and platelet adhesiveness and inhibits pancreatic bicarbonate secretion.
4. Toxic gases in cigarette smoke include CO, hydrogen sulfide, hydrocyanic acid, and oxides of nitrogen. The average carboxy-hemoglobin level in people smoking one pack/day is about 5% compared to <1% in non-smokers. This reduced the amount of Hb available of transport and shifts to the left the Hb-dissociation curve, impairing realize to the tissues.
5. According to a number of literature data, the toxic, carcinogenic, mutagenic and teratogenic effects of free radicals in the human organism are considered to have been proven. A free radical is in an atom or group of atoms that contains at least one unpaired electron. Electrons are negatively charged particles that usually occur in pairs, forming a chemically stable arrangement. If an electron is unpaired, another atom or molecule can easily bond with it, causing a chemical reaction. Because they join so readily with other compounds, free radicals can effect dramatic changes in the body, and they can cause a lot of damage. Each free radical may exist for a tiny fraction of a second, but the damage it leaves behind can be irreversible.

The presence of a dangerous number of free radicals can alter the way in which the cells code genetic material. Changes in protein structure can occur as a result of errors in protein synthesis. The body' immune system may then sere this altered protein as a foreign substance and try to destroy it. The formation of mutated proteins can eventually damage the immune system and lead to leukemia and other types of cancer, as well as a host of other diseases.

Damage Caused by Free Radicals

| Free Radicals | Damage |
|---|---|
| Superoxide | Erythrocyte lysis<br>Lung damage<br>Degradation of human synovial fluid |
| Singlet oxygen | Eye damage |
| Hydroxyl radicals | Single and double Dna strand breaks<br>Peroxidation of cell membranes |
| Nitrogen dioxide | Lipid peroxidation<br>Irreversible respiratory damage |
| Transition metals | Initiate lipid peroxidation |
| Chloroform radical | Lipid peroxidation, liver damage |
| Quinone radicals | RNA, DNA damage, chemical carcinogenesis<br>Lipid peroxidation |
| Bipyridyl radicals formation | Inhibits fatty acid synthesis, cataract |
| Phenyldiazine radical | Hemoglobin denaturation, lipid peroxide |

The diseases related to smoking are the following:

1. Lung cancer. Squamous cell and small (oat) cell lung carcinoma are associated. with smoking. Epidemiologic studies have shown that men who smoke more than one pack/day are about 20 times more at risk of developing lung cancer than are nonsmokers. Laboratory experiments show that condensed tobacco smoke can produce skin cancer in animals and when animals cigarette smoke may develop cancer of the larynx or lung.
2. Chronic bronchitis and emphysema deaths are also about 20 times more frequent in people who smoke heavily. Both diseases can be produced in animals exposed to cigarette smoke. Pulmonary function tests often show airflow obstruction in the small airways even before chronic expectation develops. The adverse effect of smoking on mucous ciliary clearance and on the normal balance between lung and protease and their inhibitors predisposes smokers to broncho-pulmonary infections and emphysema.
3. Cardiovascular diseases: Cigarette smoking accelerates arteriosclerosis and may double the risk of myocardial infarction. Smoking may precipitate in anginal attack or ischemic ECG changes in patients with coronary artery disease. The risk of developing disease, peripheral vascular disease, or nonsyphylitic aortic aneurysm is also increased in smokers.
4. Pregnancy: The mean birth weight of infants born to mothers who smoke during pregnancy is 6 oz. Less than of infants to nonsmoking mothers. The incidence of spontaneous abortion, stillbirth and neonatal death may also be increased in pregnant women who smoke.
5. Extra-pulmonary cancers associated with cigarette smoking include cancer of the mouth, pharynx, larynx, esophagus, bladder and pancreas.

6. Peptic (especially gastric) ulceration occurs more frequently and has a higher mortality rate in cigarette smokers than in non-smokers. In addition, the effectiveness of medical treatment for peptic ulceration is reduced and the rate of ulcer healing is slowed.
7. Other conditions: Pulmonary TB is more in smokers, perhaps due to activation of old tuberculosis foci. Tobacco amblyopia may be caused by optic nerve damage due to the toxic action of cyanides in cigarette smoke in smokers with vitamins deficiency.

By the U.S. Surgeon General it has estimated that in the U.S. alone about 500,000 deaths are caused each year by diseases related to tobacco smoking. In fact, excessive smoking is now recognized as one of the major health problem throughout the world.

Epidemiologists are getting better at keeping records of all this carcinogenic carnage. The body's respiratory system, for example has a well-defined local defense system. First, there are two ciliated cells with tiny hairs that line the respiratory system, the cilia prevent accumulation, if inhaled matter in the lungs by transporting the particles away from the lungs. If deciliated cells are rendered ineffective by smoke or other irritants, cells called macrophages take up their work by engulfing and digesting hazardous substances such as bacteria.

Experiments have been able to demonstrate clearly a decreased of the cilia action due to cigarette smoking. However, it has been determined that the smokers have more macrophages in their lungs than nonsmokers, which may indicate the irritation of the cilia, perhaps in response to the free radicals and to the toxic ingredients of cigarette smoke.

Studies of systemic immunological responses have been shown that cigarette smoking may decrease the body's production of antibodies, thus increasing its susceptibility to infection. It is true that the incidence of flu-like illness is greater among smokers of more than half a pack a day than among nonsmokers. In addition, pregnant women who smoke have more urinary tract infections than those who do not smoke.

A long drag on a cigarette is followed by a deep inhaling that pulls the smoke down into the air passage of the lung. Black, sticky tar, with its carcinogenic chemical constituents, is deposited on the membranes of the whole bronchial system.

Free radicals, chemicals and gases irritate the mucous membranes and damage the cilia that catch foreign matter in the passages. After years of being exposed to smoke the cilia are destroyed and the entire lung is partially or completely blackened depending on how much and how long one has smoked.

Sooner or later, the cells lining the air passages may begin to transform because of continuous exposure to free radicals and chemical carcinogens. These cells than become irregular, clump together and over a period of years may form a growing tumor. In later stages, cancer breaks away from the lung and travels through the lymphomatic system to the organs. Metastasic tumor develop and the cancer is then usually beyond treatment. The combustion of tobacco leaves at about 1000 C. Leads to the formation of a high concentration of free radicals and a large variety of inorganic or organic gases, liquids, and solids. Ignoring side-stream smoke, i.e., that which does not pass through the cigarette, the hot mixture passes through the unburned tobacco undergoing filtration, dilution with residual gases and fresh air, and enrichment with additional vaporized materials. Looking at the existing smoke on finds that both the particle size and number concentration depends on the unburned butt length, the longer the butt, the fewer and larger the particles. This effect is apparently primarily due to the action of filtration and preferential removal of smaller particles. Fresh undiluted smoke may contain several billion of free radicals and particles per cubic centimeter of air, with droplets predominant in the 0.1 to 1.0 um diameter range and solids predominant below that size. The gaseous components in fresh smoke are to numerous to list individually. Much progress has been made in the past 30 years in the ability of scientists to identify chemicals which cause cancer.

Cigarette smoke contains well over four thousand chemicals along with a number of unknown products and additives that are not regulated by agencies outside the tobacco industry (nor obviously by anyone within it). They may include pesticides (used to protect the tobacco plants from bugs), some of which have not been tested for safety.

Many of these chemicals are produced in tiny concentrations, and they may only exist in an active form for seconds before the body detoxifies them. This makes them virtually impossible to study. Despite their small amounts and transient presence, smoking is an efficient and rapid way to inject these chemicals into the lungs and the bloodstream, representing a significant risk to health in general and to lung cancer specifically. In turning toward chemicals produced by burning tobacco, one probable culprit definitely worth discussion is carbon monoxide, the same poison found in abundance in automobile exhaust. It reacts with a molecule called hemoglobin and hinders red cells' ability to carry oxygen to the heart, brain and other vital organs. The heart is called upon the deliver more blood quickly to make up for this oxygen deficit, even as its own needs are unmet. Even more serious is the fact that insufficient oxygen soon causes cells to die. Evidence of this phenomenon is all too common in autopsies of heart attack victims.

Cigarette smoking contains 2 percent to 6 percent carbon monoxide. Everyone living in the industrialized world loose some hemoglobin to carbon monoxide found in the air. However, while the average loss in nonsmokers is 1 percent, smokers lose up 15 percent. This means that smokers run a much higher risk that vital organs will not receive an adequate oxygen supply, which contributes to higher rates of heart attacks and strokes.

When tobacco is smoked, tar results, which enter into lungs, irritate the delicate cells as dangerous as a chimney soot. From a pack of cigarette a day smokers absorb eight hundred and forty cubic centimeters of tobacco tar in a year. We have known about the tar problem for a long time. Back in 1953, Dr. Ernst Wynders and his colleagues at the Memorial Sloan-Kettering Cancer Center in Manhattan showed a direct cause and effect relationship between the tar of cigarette smoke and malignant tumor. The backs of mice were painted with the tar extract of tobacco smoke, and 44 percent of the animals developed malignant skin cancer.

The irritant factor is mostly "Benzo(a)pyrene", from the tar, and when applied to ear, mouth, lungs, stomach and other organs of the animal in labor, cancer develops rapidly. Cigarette smoke involves both "a toxic gas phase", and a "particulate" phase. Most carcinogens come from particles in tar, though a few come from gases. Tar containing agents that both initiate and promote cancerous changes, and co-carcinogens that, together with other with other agents form cancer-producing chemicals. There are nitrosamines, polycyclic, aromatic hydrocarbons (PAHs) such as benzo(a) pyrene, and various metals (including arsenic) which cause or promote tumor growth, and it united with the hemoglobin in your blood cells and drastically reduces their capacity to carry life-giving oxygen to your cells and tissues, this causing anemia.

As this cornucopia of carcinogens was not enough, cigarette smoke also contains other poisonous chemicals and gases, including carbolic acid, collidine, furfuralphil, appilocarpin, formaldehyde, aldehydes, formic acid, the gases include hydrogen, cyanide, nitrogen oxide, and a hefty amount of carbon monoxide. A number of these substances have been linked in animal and human experiments to lung and other cancers, heart and circulatory diseases, bronchitis and emphysema and powerful toxin which attack brain and nerve tissues.

When smoking, tobacco combustion develops with an inordinately large number of free radicals, these poisons are inhaled into the lungs where are absorbed by the millions of tiny vessels lining the lungs. They are transformed by the bloodstream, which carries them to every cell and tissue in your body, even if you do not inhaled. Pipes and cigars smokers may also be affected by malignant tissue on the tongue or lips.

Sooner or later smokers develop a cough, the first symptoms of the lung cancer. Many pay no attention. The heartbeat and pulse as well as the blood pressure, increase smokers with normal blood pressure of one hundred and fifty, smoking might push it up to two hundred and seven. Heading the list of results are these: brain strokes, along with heart attacks and coronary thromboses. There is scarcely a single bodily function which is not impaired by smoking. Other results included: acid indigestion, flatulence, nausea, belching, ulcers, allergies, asthma and bronchitis.

Consequently the consensus of everyone from the Surgeon General and National Academy of Science to the American Cancer is that there is no safe cigarette.

Cigarette smoking is known to alter components of the body's immune system. When the body is invaded by a substance that is recognized as "Foreign" the body's immune system reacts by creating antibody to attack the following substances. This response may occur locally (at a specific organ site) or systematically (throughout the body).

Attempts to remove the free radicals and the carcinogenic materials found in the smoke tobacco, have not been successful enough to bring a safer smoking articles to the public market, since no adequate filtering means has not yet been invented, which can effectively remove free radicals and the carcinogenic substances without simultaneously removing most part of the desirable aroma and taste of the smoking articles.

Antioxidants are indispensable organic compounds which take part in various biochemical processes. Antioxidant substances have proven to remove free radical and therefore be able to prevent chemical and spontaneous carcinogens in the epithelial tissue of the bronchi, trachea, stomach, skin, uterus and prostate in men and in animals, both in vitro and in vivo. Various mechanisms have been suggested to explain these anti-carcinogen effects and epidemiologic studies are currently testing the relationship between antioxidants and cancer in cancer patients and matched controls.

Ever since it has been universally recognized that the smoke combustion of tobacco produces carcinogens that cannot be satisfactory filtered out without destroying the pleasure of smoking, there has been a need as cancer prevention for a safe cigarette filter containing antioxidants and other filtering substances, which insure the removal of free radicals and other carcinogenic substances, at a controlled rate and continuously during the entire process, preventing smoke related diseases into the respiratory tract of the smoke.

Therefore, the object of this invention is to remove free radicals and other carcinogenic ingredients to make safer to people to smoke not as safe as not smoking, but considerably safer than it is now.

Let's consider why people continue to smoke. They don't quit because smoking gives them certain benefits. Many campaigners for the elimination of cigarette smoking have not realized that people would lose these benefits, as well as the health risks. Tobacco has significant effects on behavior and psychological state. Recent research has shown that cigarette smokers (and other who use tobacco) find that tobacco use makes it easier to cope with over-stimulation like city noise and overcrowding. That's because the nicotine in cigarette smoke is a stimulation barrier, a substance that makes it easier for a person to function in an over-stimulating environment.

Although tobacco smoke filters have come into widespread use, especially for cigarettes, these currently available filters do not remove an adequate amount of the noxious substances, such as tar, nicotine, carbon monoxide, nitrous oxides, hydrogen cyanide and the like which typically lead to cancer, hearth disease or emphysema, Several types of tobacco smoke filters as well as tobacco substitutes have been developed in an attempt to reduce the health hazards of tobacco smoke and at the same time allow the smoker to enjoy the pleasure of smoking tobacco. However, none of the current filters, or tobacco substitutes has proven to be effective in adequately large amounts of tar, and nicotine and noxious gases to reduce the heath hazards of tobacco smoke.

The commonly utilized cigarette filter available on the market removes from tobacco smoke only a fraction of the carcinogenic constituents present within, allowing most of the droplets passing through it.

It can be stated from the literature that a high number of processes are worldwide known which suggest methods for the filtration of the tobacco smoke. It can also be stated from the literature that a high number of processes are worldwide known which suggest methods for the filtration of the tobacco smoke. It can also be stated that, in spite of the very high number of data concerning this subject, no conscious, conceptional method exists for the contaminants released in the burning and being present in the tobacco smoke which, as it is commonly known, arises from a high-temperature burning.

Nowadays, innumerable processes used for filtering tobacco smoke are known. A great number of publications have been devoted to the additives of the smoke filters. These additives in the smoke filter are aimed to absorb and/or absorb a certain ratio of the harmful components of cigarette smoke according to the eventual physical and/or physico-chemical relationships coming about between the constituents of the smoke filter and the components being present in the tobacco smoke.

A plethora of patented processes are particularly found under the collective noun of "substances binding and filtering out carcinogenic smoke components".

Through my scientific research, we now know why people smoke, what real psychological and behavioral benefits smoking provides, what the major molecular mechanisms are which make smoking hazardous, and finally, how to reduce the hazards of smoking without reducing those benefits of smoking pleasure.

SUMMARY OF THE INVENTION

The aim of the present invention is to develop a dual stage filter composition for tobacco smoke, mainly for cigarette smoke, which is capable to bind completely or nearly completely not only free radicals, but also the tar and other boiling health damaging materials arising from the burning of tobacco.

The object of the present invention is achieved by compounding inert, stable and non toxic micro-powdered minerals and antioxidants, which set the stage for conducting the contemplated desired reactions such as: trapping, diffusion, interception, impaction, chelation, coupling, catalyzing the very dangerous and poisonous gas, particles and the free radicals from tobacco smoke during the process of smoking.

In accordance with the present invention the compound disclosed herein is effective in reducing considerably the amount of free radicals, and many other harmful smoke constituents, which are not limited to: acetaldehyde, acetone, acrolein, acrylonitrile, ammonia, 4-amino-biphenyl, benzene, 1–3 butadiene, butyraldehyde, cadmium, carbon monoxide, catechol, crotonaldehyde, formaldehyde, hydrogen cyanide, hydrogen selenide, lead, m,p and o-cresol, mercury, methyl ethyl ketone, nickel, n-nitrosamines, nitric oxide, p-hydroquinone, phenol, propionaldehyde, quinoline, styrene, tar, toluene, etc.

One further purpose of the invention is to provide a dual device filter applicable to cigarettes, cigars, pipes or their filters and/or holders which permit to effect local filtering of carcinogenic substances according to the system outlined above.

One object of this invention is to provide a novel tobacco filter to be inserted in a pipe, cigar, cigarette or any other tobacco smoking article loaded with antioxidants and filtering substances which aims it is to neutralize free radicals and the carcinogenic effect of the harmful ingredients in tobacco smoke.

Accordingly, it is an object of the present invention to provide filter to be used by persons smoking tobacco, which is capable of reducing the amount of contaminants in the smoking passing to the person's mouth to a safe value.

Another object of the invention is to provide an improved filter to be used in connection with smoking cigarettes, cigars, the like which is capable of removing a larger quantity of tars and other potentially harmful substances from the smoke, rendering the smoke entering the person's mouth relatively harmless to the person's system.

A further object of the invention is to provide an improved filter to be used smoking tobacco, which not is capable of effectively removing harmful ingredients from the smoke, but also to cool the smoke considerably.

The primary object of this invention has been to improve the filtering of tobacco smoke, particularly by synergistically combining absorption with the magneto-chemical treatment of the noxious components of the smoke, and control diffusion of free radicals and exerts a free radical scavenging effect.

Reduced to its essential structure and with reference to the figures of the enclosed drawings, a tobacco smoke filter effective in removing harmful ingredients from cigarette smoke, comprises:

means to remove from tobacco smoke free radicals and other harmful ingredients, and to bring the amount of such ingredients passed by the filter down well within a tolerable limit, without significantly removing moisture from the smoke and without impairing the enjoyment of smoking, by a filter composition comprising a mixture of antioxidants and minerals divided in two stages.

means to remove free radicals, by a first chamber (3) of the filter, inside which the smoke initially pass through, which is constituted by non absorbent antioxidants;

means to reduce the carcinogenic substances contained in the tobacco smoke, and possible residues of antioxidants, by a second chamber (2) constituted by minerals.

This invention relates to a new tobacco filter material useful for the removal of noxious and irritative material from tobacco smoke. More particularly, the instant invention is concerned with an improved tobacco smoke filter material comprising stable and non toxic antioxidants and mineral compositions divided in two groups.

The first group includes antioxidants such as: Ascorbic Acid, Butylparaben, Citric Acid, Glutathione, Melatonin, Resveratrol, Selenium, Ubiquinones and Green tea.

The second group includes minerals such as: Activated Carbon, Clinoptilolite, Cuprous Chloride and Ferrite.

All for use in such filter for the removal of noxious contaminants and free radicals from tobacco smoke.

The embodiments of the tobacco dual smoke filter of the present invention concern of a cylindrical tobacco smoke filter (1) assembly consisting of a tube with two chamber (2, 3) separated from each other by a partition (4) of cellulose acetate made from a fibrous material selected from the group consisting of paper, cellulose acetate, viscose base and other types of plastics and/or metal, said tube may be embodied in a filter type cigarette (FIGS. 5 and 6) or in a holder for the cigarette (FIGS. 1 and 4), cigars, or pipe tobacco (FIG. 7), which such porosity to permit the passage of smoke through, said tube containing in the first chamber (3) loosely packet filter material consisting essentially of Antioxidants effective in the removal of free radical developed during the smoking combustion and in the second chamber (2) separated from the first one, with a cellulose acetate filtering material, consisting of non-toxic absorbent minerals designed to remove from tobacco smoke most of the noxious particles and gases of the tobacco smoke.

During smoking the combination of the high temperature and created suction force, the nicotine, tar and all impurities such as chemical particles, melt having the consistency of a thick liquid. As the liquefied noxious contaminants and gases including free radicals come into contact with the filter, most of them are absorbed.

The scope to have antioxidants in a separate chamber is due to the fact if for some unknown chamber is due to the fact if for some unknown reason, the high temperature of the tobacco smoke will melt even a small fraction of the antioxidants the same will be removed completely by the mineral compound positioned in the second chamber.

The dual filter object of this invention can absorb up to approximately 90% of such free radicals and contaminants before the smoke is inhaled, thus producing a cleaner smoke with a very limited health detriment to the smoker.

The synergist composition of the antioxidants and minerals object of the present invention calculated for each filter (in one cigarette, one cigar or a pipe) should be an amount approximately between 50 to 100 mg., then the homogenized mixture of the composition as radical scavenger and minerals as adsorbed to remove noxious particles and gases from tobacco smoke are placed between the filter separated by each other.

Hereby is the list of the Antioxidants and Minerals object of the present invention but such list should not be limited to the following:

Vitamin C (Ascorbic Acid)

The story of vitamin C begins centuries before the discovery of the vitamin, with accounts of a disease call scurvy.

Scurvy an ailment characterized by muscle weakness, lethargy and bleeding under the skin has been rampant around the world throughout the centuries. Documents written before the birth of Christ describe the disease. Almost as old as the reports of the disease are the reports of successful ways of treating it. The discovery of the cure for scurvy marked the end of one chapter in the story of vitamin C.

Vitamin C is often added to foods as a preservative because it interferes with oxidation. It is added to some cured meats because it inhibits the formation of nitrosamines.

Vitamin C is a very powerful antioxidant that also protects other antioxidants, such as vitamin E. The cells of the brain and spinal cord, which frequently incur free radical damage, can be protected by significant amount of vitamin C. Vitamin C acts as a more potent free radical scavenger in the presence of a bioflavonoid called hesperidin.

In addition to its role as an antioxidant, vitamin C detoxifies many harmful substances and plays a key role in immunity. It increases the synthesis of interferon, a natural antiviral substance produced by the body, and stimulates the activity of certain key immune cells.

Butylparaben

Butylparaben is prepared by esterification of p-hydroxybenzoic acid with butanol, small, colorless crystals or white powder. Very slightly soluble in water; freely soluble in alcohol, ether, chloroform. An antiseptic and preservative, with actions and uses similar to those of methylparaben, with which it is sometimes used in combination. It appears to be the best antifungal agent among the parabens. It is used in antiseptic creams and ointments, and in many pharmaceutical products as antioxidants.

Butylparaben is an Antioxidant substance capable of inhibiting oxidation and that may be added for this purpose to pharmaceutical products subject to deterioration by oxidative processes as, for example, the development of rancidity in oils and fats or the inactivation of some medicinals in the environment of their dosage forms. As preservative is, in the common pharmaceutical sense, a substance that prevents or inhibits microbial growth and may be added to pharmaceutical preparations for this purpose to avoid consequent spoilage of the preparations by microorganisms.

Citric Acid

It's found in many plants. It formerly was obtained solely from the juice of limes and lemons and from pineapple wastes. Since about 1925 the acid has been produced largely by fermentation of sucrose solution, including molasses, by fungi belonging to the *Apergillus niger* group, theoretically according to the following reactions: $C_{12}H_{22}O_{11}$ (Sucrose)+ $30_2$ (Oxygen)>$2H_3C_6H_5O_7$ (Citric Acid)+$3H_2O$ (Water). But in practice there are deviations from this stoichiometric relationship.

Colorless, translucent crystals, or a white, granular to fine crystalline powder; odorless; strongly acid taste; the hydrous form effloresces in moderate dry air, but is slightly deliquescent in moist air; are subject to molding (fermentation), oxalic acid being one of the fermentation products.

In the preparation of Anticoagulant Citrate Dextrose Solution, Anticoagulant Citrate Phosphate Dextrose Solution, Citric Acid Syrup and effervescent salts. It also has been used to dissolve urinary bladder calculi, and as a mild astringent.

Citric Acid is used as acidulant in beverages, confectionery, effervescent salts, in pharmaceutical syrup, elixirs, in effervescent powders and tablets, to adjust the pH of foods and as synergestic antioxidant, in processing cheese. Used in beverage, jellies, jams, preserves and candy to provide tartness. In the manufacturing resins, in esterified form as plasticizer, foam inhibitor. In the manufacturer of citric acid salts. As sequestering agent to remove trace metals. As mordant to brighten colors; in determining citrate-soluble $P_2O_5$; as reagent for albumin, mucin, glucose, bile pigments.

Glutathione

Glutathione is a protein that is produced in the liver from the amino acids cysteine, glutamic acid, and glycine. It is a powerful antioxidant that inhibits the formation of, and protects against cellular damage from, free radicals. It helps to defend the against damage from cigarette smoking exposure to radiation, cancer chemotherapy, and toxins such as alcohol. As a detoxifier of heavy metals and drugs, it aids in the treatment of blood and liver disorders.

Glutathione protects cells in several ways. It neutralizes oxygen molecules before they can harm cells. Together with selenium, it forms the enzyme glutathione peroxides, which neutralize hydrogen peroxides. It is also a component of another antioxidant enzyme, glutathione-s-transferase, which is a broad-spectrum liver-detoxyfying enzyme.

Glutathione protects not only individual cells but also the tissues of the arteries, brain, heart, immune cells, kidneys, lenses of the eyes, liver, lungs, and skin against oxidant damage. It plays a role in preventing cancer, especially liver cancer, and may also have an anti-aging effect. Glutathione can be taken in supplement form. The production of glutathione by the body can be boosted by taking supplemental N-acetylcysteine or L-cysteine plus L-methionine. Studies suggest that this may be a better way or rising glutathione levels than taking glutathione itself.

Glutathione is necessary for white blood cell function and is used by the liver to help detoxify drugs. Optimal levels of gluthatione are needed for the immune defenses of the lungs: deficiencies may increase the risk of lung infections.

Melatonin

Among the newest antioxidants to be discovered, the hormone melatonin may also be the most efficient free radical scavenger that has thus far been identified. While most antioxidants work only in certain parts of certain cells, melatonin can permeate any cell in any part of the body. In animal experiments, it has been shown to protect tissues from an amazing array of assaults. Within the cell, melatonin provides special protection for the nucleus the central structure that contains the DNA. Thus, it protects the structure that enables a damaged cell to repair itself. Melatonin also stimulates the enzyme glutathione peroxidase, another antioxidant.

The hormone melatonin is naturally produced by the pineal gland, a cone-shaped structure in the brain. Throughout early life, melatonin is produced in abundance. Shortly before puberty, though, the production of melatonin begins to drop, and then continues to decline steadily as we age.

Research has demonstrated that melatonin may have several profound long-term effects on the body. As one of the most powerful antioxidants ever discovered with a greater range of effectiveness than vitamin C, vitamin E, or beta-carotene, melatonin helps prevent harmful oxidation reactions from occurring. In this way, melatonin may prevent the change that lead to hypertension and heart attack, and may reduce the risk of certain kinds of cancer. Indeed, research has indicated that many age-related problems are caused by declining levels of melatonin, which leave the body less able to prevent and repair oxidative damage. Melatonin also has been found to stimulate the immune system; have a major role in the production of estrogen, testosterone, and possibly other hormones, helping to prevent cancers involving the reproductive system; and slow the growth of existing malignancies.

Recent studies suggest that if melatonin is taken in the mornings, tumor growth may be stimulated, but if it is taken in the evenings, it has a retarding effect on tumor growth. In addition, as melatonin is secreted clinically, in response to the fall of darkness at the end of each day, the hormone helps our body keep in sync with the rhythms of day and night. Thus, melatonin helps regulate sleep.

Research on melatonin continues, and with it, knowledge is increasing about the functions of melatonin in the body and the effects of melatoni supplementation. Both human research studies and anecdotal evidence indicate that melatonin supplements can be an effective and side-effect-free sleep aid both for adults suffering from insomnia and for children with autism, epilepsy, Down syndrome, cerebral palsy, and other problems that can cause sleep disorders. Animal and other laboratory research indicates that melatonin supplementation may help prevent age-related disorders, and perhaps extend life. Melatonin can be taken to ease PMS symptoms; stimulate the immune system; prevent memory loss, arteriosclerosis, and stroke; and treat cancer and Alzheimer's disease.

Resveratrol

In Europe, Resveratrol as antioxidant was isolated from grapewines in 1976 and extensively studies for its antifungal activity and its potential use as a marker for selection of disease resistant grape cultivars.

Instead in China and in Japan, Resveratrol has been extensively studied not for its role in the plant's defense against diseases, but as active ingredient of several traditional medicines used for centuries.

In Japan, Resveratrol isolated from the root of the herb Polygonum Cuspidatum (Polygonaceae) was found to inhibit fat deposition in the liver and improved serum chemistry in hyperlipenic rats. In addition Resveratrol demonstrated as variety of pharmaceutical effects in mammalian in vitro and in vivo studies.

Resveratrol is a phytoalexin, in grape is readily transferred to red wine by fermentation alcohol extraction. Clinical studies showing results on heart effects of wine consumption suggesting that Resveratrol play an important role in human health.

Selenium

Selenium was named for the goddess of the moon, Selene; but for nutrition it has been a shining star of the last decade. Nor since the recognition of the mineral cobalt as part of vitamin B-12 in the mid 1950s has a mineral been recognized as having a precisely definable function in human or animal nutrition has happened with selenium. In 1973, Dr. J. T. Rotruck (then at the University of Wisconsin) and his associates identified selenium as a necessary component of an enzyme, glutathione peroxidase.

As a component of glutathione peroxidase, and perhaps with other functions, selenium is believed by many people to protect cell membranes, prevent cardiovascular diseases, reduce the incidence of cancer, suppress arthritis, reduce aging and contribute generally to better health. It is probable that the formal recognition of selenium as a nutrient by the Food and Nutrition Board of the National Research Council (1980), their issuance of dietary guidelines for selenium, recognition of Keshan Disease in the Peoples Republic of China as a selenium deficiency disease, deficiencies of selenium in the diets of the Scandinavian countries and elsewhere may soon result in a significant portion of the world's population receiving selenium supplements. Animals already do.

A partner and synergist with vitamin E, selenium is also an essential component of the antioxidant enzyme glutathione peroxidase (each molecule of this enzyme contains four atoms of selenium). This enzyme targets harmful hydrogen peroxide in the body and converts it into water. It is a particularly important guardian of the blood cells and of the heart, liver and lungs. Selenium also stimulates increased antibody response to infection. Some important facts about selenium include:

- Selenium's relationship to human health is an established fact.
- The recommended daily intake of selenium is 50 to 2000 micrograms.
- Several high regarded scientists have state that millions of Americans receive less than optimum amounts of selenium in their diets
- Many people live in areas with low soil selenium availability.
- Selenium can help prevent many forms of cancer.
- Selenium can help protect against heart disease.
- Selenium strengthens your immune system.
- Selenium may improve your energy level.
- Selenium helps prevent or relieve arthritis.
- Selenium can slow down evidence of aging and help make you look younger.
- Selenium detoxifies several heavy metal pollutants including cadmium, mercury and probably lead.
- Selenium may prevent the onset of cataracts.
- Selenium may affect fertility, sex drive and human reproduction.

Ubiquinones

A group of lipid-soluble benzoquinones involved in electron transport in mitochondrial preparations, i.e. in the oxidation of succinate or reduced nicotine adenine dinucleotide (NADH) via the cytochrome system. It occurs in the majority of aerobic organisms, from bacteria to higher plants and animals. Ubiquinone structures, analogous to the vitamin $K_2$, are based on the 2,3-dimethoxy-5-methylbenzoquinone nucleus with a variable terpenoid side chain counting one to twelve mono-unsaturated trans-isoprenoid units with 10 units being the most common in animals. According to the existing dual system of nomenclature the compounds can be described as: coenzyme $Q_n$ in which n=1–12, or ubiquinone(x) in which x designates the total number of carbon atoms in the side chain and can be any multiple of 5. Differences in properties are due to the difference in length of the side chain. Naturally occurring members are the coenzymes $Q_6$–$Q_{10}$.

Activated Carbon

A powdered, granular or pelleted form of amorphous carbon characterized by very large surface area per unit volume because of an enormous number of fine pores. Activated carbon is capable of collecting gases, liquids, or dissolved substances on the surface of its pores.

Adsorption on activated carbon is selective, favoring non-polar over polar substances. Compared with other commercial absorbents, activated carbon has a broad spectrum of adsorptive activity, excellent physical and chemical stability, and ease of the production from readily available, frequently waste materials.

Almost any carbonaceous raw material can be used for the manufacture of activated carbon. Wood, peat, and lignite are commonly for the decolorizing materials. Nut shells (particularly coconut), coal, petroleum coke, and other residues in either granular, briqueted, or pelleted form are used for adsorbent products.

Activation is the process of treating the carbon to open an enormous number of pores in the 1.2–to 20-nanometer-diameter range (gas-adsorbent carbon) or up to 100-nm-diameter range (decolorozing carbons). After activation, the carbon has the large surface area (500–1500 m2/g) responsible for the adsorption phenomena. Carbons that have not been subjected previously to high temperatures are easiest to activate. Selective oxidation of the base carbon with steam, carbon dioxide, fuel gas, or air is one method of developing the pore structure.

Activated carbon is a fine, black, odorless and tasteless powder, free from gritty matter with a powerful adsorption capacity to trap, chelate, catalyze, gases and particulate matter.

Clinoptilolite

Clinoptilolite, a natural occurring volcanic zeolite mineral with unique characteristics. Its chemical structure can be classified as hydrated, aluminosilicate, comprises of $SiO_2$, $AL_2O_3$, CaO, MgO, $TiO_2$, $Na_2O$, $K_2O$, $Fe_2O_3$, MnO, arranged in interconnecting lattice structure. The arrangement of these elements in a zeolite crystal gives rise to a honeycomb framework with consistent diameter connecting channels that vary in size from 22.5 to 5.0 angstroms.

This unique structure makes Clinoptililite different from other Aluminum Silicates (zeolite, kaolin, bentonite, etc.) due to its extraordinary gas adsorption properties.

The ability of Clinoptilolite to adsorb or catalytically remove many gases on a selective basis is in part determined by the size of the channels. Such specific channel size enables Clinoptilolite to act as molecular gas sieves and selectively adsorb and remove gases from composite gaseous mixtures such ass the ones contained in tobacco smoke. Is seemingly endless.

The following list depicts just few of those gases on which Clinoptililite are currently known to have an effect on their elimination or containment:

Co, $Co_2$, $SO_2$, $H_2S$, $NH_3$, HCHO, Ar, $O_2$, $N_2$, $H_2O$, He, $H_2$,

Kr, Xe, $CH_3OH$, Freon, Formaldehyde, etc.

Cuprous Chloride

Culprous chloride occurs in nature as mineral mantokite is colorless to gray, and come up as white crystal powder or cubic crystals (zinc-blend structure); stable to air and light, but in presence of moisture turns green on exposure to air and blue to brown on exposure to light.

Sparingly soluble in water with partial decomposition, practically insoluble in alcohol, acetone, hydrochloric acid and other formation of complexes.

As catalyst for organic reactions; catalyst decolorizer and desulfuring agent in petrol industry; in denitration of cellulose; as condensing agent for soaps, fats and oils; in gas analysis to absorb carbon monoxide.

Ferrite

Any of the class of magnetic oxides. Typically the ferrites have a crystal structure which has more than one type of site for the cations. Usually the magnetic moments of the metal ions on sites of one type are parallel to each other, and antiparallel to the moments on at least one site of another type. Thus ferrites exhibit ferromagnetism.

There are three important classes of commercial ferrites:

One class has the spinel structure, with the general formula $M_2+Fe_2^{3+}+O_4$, where $M^{2+}$ is a divalent metal ion. So-called linear ferrites used in inductors and transformers are made of Mn and Zn (for frequencies up to 1<mhz) and Ni and Zn (for frequencies greater that 1 MHz)and Ni and Zn (for frequencies greater that 1 MHz). MgMn ferrites are used in microwave devices such as isolators and circulators.

The second class of commercially important ferrites have the garnet structure with the formula $M^3{}_3+Fe^3{}_5+O_{12}$, where $M^{3+}$ is a rare-earth or yttrium ion.

The third class of ferrites has a hexagonal structure, of the $M^2+Fe^3{}_{12}+O_{19}$ magneto-plumbite type, where $M^2$ is usually Ba, Sr, or Pb. Because of their large magnetocrystalline anisotropy, the hexagonal ferrites develop high coercivity and are an important member of the permanent magnet family.

Another magnetic oxide, y-$Fe_2O_3$ also has the spinel structure, but has no divalent cations. It is the most commonly used material in the preparation of magnetic recording tapes.

The largest usage of ferrite measured in terms of material weight is in the nonlinear B/h range, and is found in the form if deflecting yokes and flyback transformers for television receivers.

In details the present invention relates to the mineral composition which include a novel magnetized active carbon, comprising activated carbon and a magnetized ferrite powder mixed therewith, a method for reinforcing activities of active carbon using this magnetized active carbon to prevent damage caused by free radicals and from all other contaminants of tobacco smoke.

The present invention has been completed as a result of research work made with a view to highly reinforcing activities of magnetized active carbon such as adsorbing catalytic free radical scavenging capabilities and substantially increase the effectiveness of the filter reducing the content of noxious materials in the tobacco smoke, while leaving the drawing quality unimpaired.

According to another aspect of the present invention there is provided a minerals composition comprising active carbon and a magnetized ferrite mixed therewith which is effectively used for removing free radicals, carbon monoxide, hydrogen and the like from cigarette or tobacco smoke.

Magnetized active carbon and the other minerals of the present composition have a capacity to absorb a variety of gaseous components ranging from those having a relatively low molecular weight to those having a high molecular weight, and it shows high adsorbing capacity even when the concentration of these gaseous components is very low. Further, the activities of magnetized active carbon are scarcely influenced by humidity, and it is able to exhibit its special capacities.

Magnetized active carbon has also catalytic effect on sulfurous acid gas, nitrogen oxides, ozone, chlorine and the like.

The activated charcoal of the present invention has a specific surface area exceeding a million square centimeters per gram, a particle size between 8 to 50 mesh and impregnated with about 1% to 13%, preferably 4% to 6% by weight thereof of a magnetized micro-powdered ferrite in an amount not exceeding about 14% of the weight of the charcoal granules.

Activated charcoal of gas adsorbed grade has a specific surface area in excess of 5 million square centimeters per gram and may be manufactured from coconut husk or bituminous coal. The particles are of such size that they will pass through a U.S. Series No. 8 sieve because larger particles are difficult to handle and to incorporate into a tobacco smoke filter cartridge but they should not pass through a U.S. Series No. 50 sieve because particles smaller than that adversely affect the draw resistance of the filter.

Magnetized substances such as Ferrite oxide and the like are preferably incorporated in active carbon according to the present invention. In general, there may also be employed magnetized ferromagnetic substances such as ferrite of the inverse-spinel type structure, ferrite of the probeskite structure, ferrite of the illmenite structure, ferrite of the rutile type structure and strontium ferrite.

According to the laboratory test on the formulation of the present invention confirm that the carcinogenic substance content of the tobacco smoke will be diminished by the synergetic effect of the various types of ingredients of the formulation.

This has also been proved by experiments, namely, when the tobacco smoke condense was introduced into a solution containing the composition of the present invention, the phenomenon of the free radical development by tobacco burning, were considerably decreased or eliminated to a significant extent. It is obvious that not only harmful contaminants free radicals were removed but also many dangerous contaminants.

However the laboratory experiments carried out on the basis of this invention lead to the surprising unexpected result that the formulation considerably decrease the amount of free radicals and remove deleterious carcinogenic substances arises from tobacco high-temperature burning.

The Antioxidants and the mineral contemplated in the present synergist composition should be, after are through mixed, introduced into the fibrous base filter in two stages, first the antioxidants to be effective as free radical scavenger and than after the minerals will eliminate to a significant extent the carcinogenic substance contained in the tobacco smoke.

The ingredients of the tobacco smoke filter of the present composition due to the mutual strengthening effect on each other, such synergistic achievement is capable to bind and to remove up to nearly 90% of the free radicals and 75% of the other dangerous contaminants of tobacco smoke.

In the present filter compound, the removal of most of the free radicals and other harmful tobacco contaminants are accomplished by a combination of diffusion, free radicals and other impact, and direct collision of the droplets with the filter compound. Upon collision the droplets are retained on the compound by the surface attraction between the extremely small particles and the relatively large particles of the powdered compound. Such compound is also particularly effective for removing vaporized components from the smoke stream by the processes of physical and chemical adsorption.

It is furthermore to be noted that in addition to the direct reduction of the total amount of combustion gases drawn from tobacco, there occurs still a further effect, namely, that of decreasing toxicity.

When tobacco smoke passes into the filter, large quantities of tar, nicotine and other noxious substances are absorbed by the filter and will fail to reach the smoker, with the result to significantly reducing the hazards of smoking tobacco.

The antioxidants and the filtering substances, when employed have the advantage to avoid free radicals and the toxic effects of smoking on the respiratory tract and may contain many different formulation; and it is obvious that the desired formulations may be varied in many ways and should not be limited to any theory of the invention or why it is physiologically tolerable by the smoker. The information given here are only by way of illustration and not by way of recommendation of smoke or to increase the quantity of tobacco to be smoked.

Having not fully described this invention, it will be appreciated by those skilled in the art that the same can be performed with a wide range of concentrations without departing from the spirit and scope of the invention.

When the invention has been described and disclosed in certain terms and has been illustrated by disclosure of certain embodiments or modifications, persons skilled in the art who have acquainted themselves with the invention will appreciate that it is not necessarily limited by such terms nor to the specific embodiments and modifications disclosed herein. Thus, a wide variety of alternatives, suggested by the teachings herein, can be practiced without departing from the spirit of the invention, and rights to such alternatives are particularly reserved, especially those which fall within the scope of appended claims.

BRIEF DESCRIPTION OF DRAWINGS

These and further characteristics of the present invention can be better understood by every expert in this field by reading the following description and referring to the enclosed drawings, given as practical examples of the invention, but not to be considered restrictive.

DETAILED DESCRIPTION OF THE INVENTION

Figure 1:
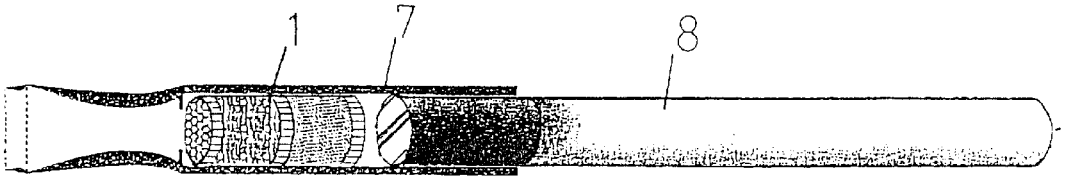
FIG. 1 shows the filter at issue (1) inserted inside a cigarette holder (7) and applied to a traditional cigarette (8).

As seen in the drawings, this invention relates to a new tobacco filter material useful for the removal of noxious and irritative material from tobacco smoke. More particularly, the instant invention is concerned with an improved tobacco smoke filter material comprising stable and non toxic antioxidants and mineral compositions divided in two groups. The first group includes antioxidants such as: Ascorbic Acid, Butylparaben, Citric Acid, Glutathione, Melatonin, Resveratrol, Selenium, Ubiquinones and Green tea. The second group includes minerals such as: Activated Carbon, Clinoptilolite, Cuprous Chloride and Ferrite. All for use in such filter for the removal of noxious contaminants and free radicals from tobacco smoke.

The embodiments of the tobacco dual smoke filter of the present invention concern of a cylindrical tobacco smoke filter (1) assembly consisting of a tube with two chamber (2, 3) separated from each other by a partition (4) of cellulose acetate made from a fibrous material selected from the group consisting of paper, cellulose acetate, viscose base and other types of plastics and/or metal, said tube may be embodied in a filter type cigarette (FIGS. 5 and 6) or in a holder for the cigarette (FIGS. 1 and 4), cigars, or pipe tobacco (FIG. 7), which such porosity to permit the passage of smoke through, said tube containing in the first chamber (3) loosely packet filter material consisting essentially of Antioxidants effective in the removal of free radical developed during the smoking combustion and in the second chamber (2) separated from the first one, with a cellulose acetate filtering material, consisting of non-toxic absorbent minerals designed to remove from tobacco smoke most of the noxious particles and gases of the tobacco smoke.

Reduced to its essential structure and with reference to the figures of the enclosed drawings, a tobacco smoke filter effective in removing harmful ingredients from cigarette smoke, comprises:

means to remove from tobacco smoke free radicals and other harmful ingredients, and to bring the amount of such ingredients passed by the filter down well within a tolerable limit, without significantly removing moisture from the smoke and without impairing the enjoyment of smoking, by a filter composition comprising a mixture of antioxidants and minerals divided in two stages.

means to remove free radicals, by a first chamber (3) of the filter, inside which the smoke initially pass through, which is constituted by non absorbent antioxidants;

means to reduce the carcinogenic substances contained in the tobacco smoke, and possible residues of antioxidants, by a second chamber (2) constituted by minerals.

Figure 2:
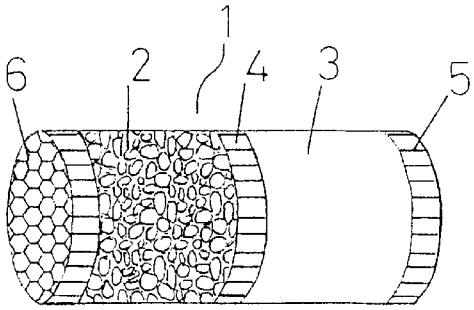
FIG. 2 shows the filter in detail, with the two chambers (2, 3) separated from each other by a partition of cellulose acetate (4). The first chamber (3) contains loosely packet filter material consisting essentially of Antioxidants effective in the removal of free radical developed during the smoking combustion; the second chamber (2), separated from the first one, comprises cellulose acetate filtering material, consisting of non-toxic absorbent minerals designed to remove from tobacco smoke most of the noxious particles and gases of the tobacco smoke. The two chambers are further isolated from the external environment at their ends by two partitions of cellulose (5, 6), realized with the same material of the central one (4), which constitutes also the outside layer of the entire filter.
Figure 3:
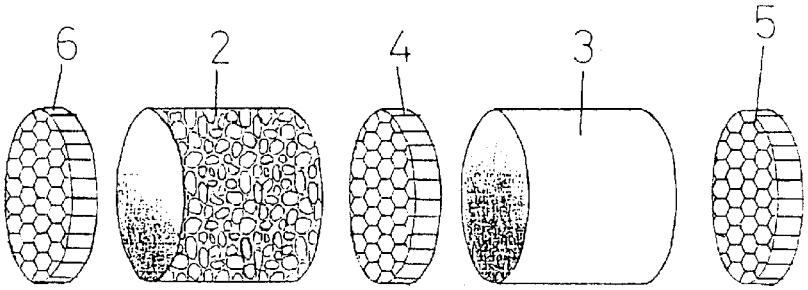
FIG. 3 shows the exploded view of the same drawing as FIG. 2.

FIG. 1 shows the filter at issue (1) inserted inside a cigarette holder (7) and applied to a traditional cigarette (8). FIG. 2 shows the filter in detail, with the two chambers (2, 3) separated from each other by a partition of cellulose acetate (4). The first chamber (3) contains loosely packet filter material consisting essentially of Antioxidants effective in the removal of free radical developed during the smoking combustion; the second chamber (2), separated from the first one, comprises cellulose acetate filtering material, consisting of non-toxic absorbent minerals designed to remove from tobacco smoke most of the noxious particles and gases of the tobacco smoke. The two chambers are further isolated from the external environment at their ends by two partitions of cellulose (5, 6), realized with the same material of the central one (4), which constitutes also the outside layer of the entire filter.

Figure 4:
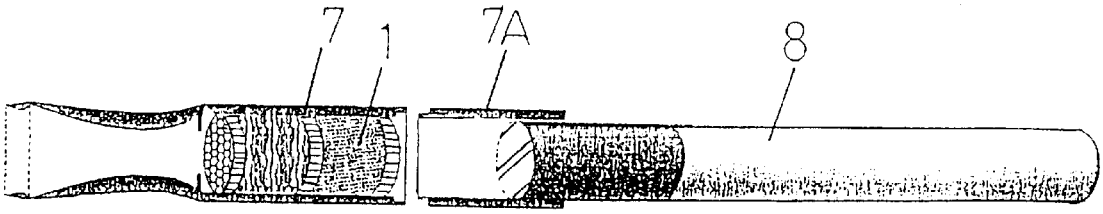
FIG. 4 shows a different solution where the filter (1) is included inside a cigarette holder formed by a first part (7), containing the filter, and a second part (7A) where it fits and inside which the cigarette (8) is inserted.
Figure 5:
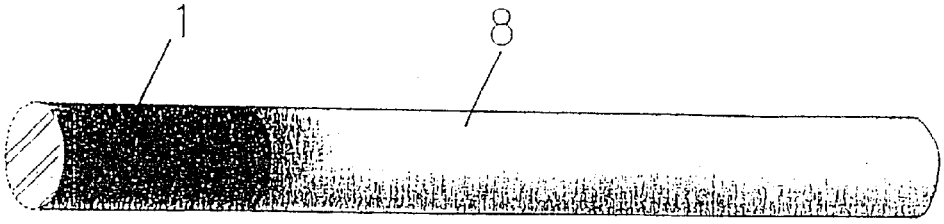
FIG. 5 shows a traditional cigarette (8), which embodies the filter (1).
Figure 6:
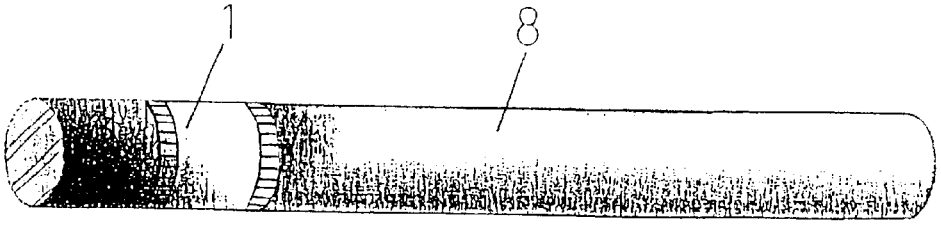
FIG. 6 shows the same drawing as FIG. 5, highlighting the inside of the filter (1) embodied into the cigarette (8).
Figure 7:
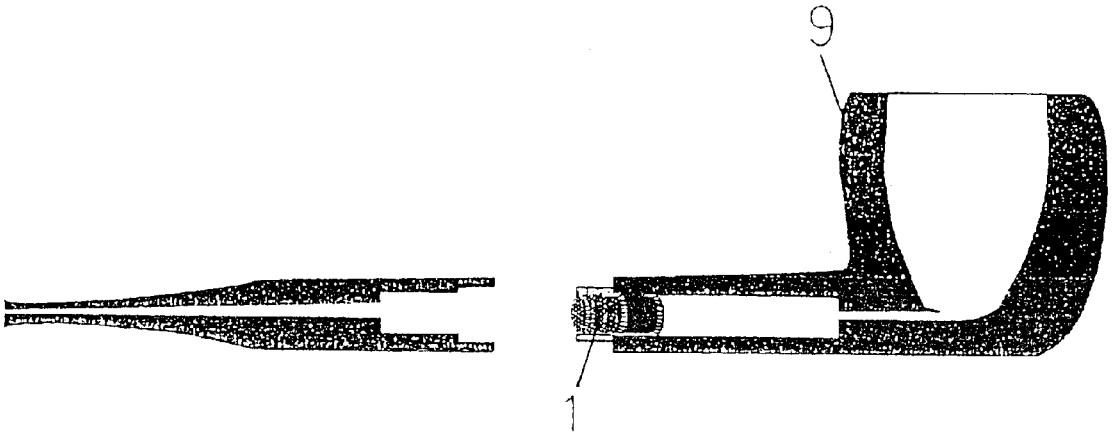
FIG. 7 shows a pipe (9) inside which the filter (1) is inserted.

FIG. 4 shows a different solution where the filter (1) is included inside a cigarette holder formed by a first part (7), containing the filter, and a second part (7A) where it fits and inside which the cigarette (8) is inserted. FIG. 5 shows a traditional cigarette (8), which embodies the filter (1). FIG. 6 shows the same drawing as FIG. 5, highlighting the inside of the filter (1) embodied into the cigarette (8). FIG. 7 shows a pipe (9) inside which the filter (1) is inserted.

Some of the advantages and characteristics of the present invention include, but are not limited to, the following:

1. Tobacco smoke filter composition to insert in cigarettes, cigars and pipes, or in cigarette holders or other smoking articles, which contains several antioxidants as radicals scavenger and minerals, capable of removing a large quantity of potential harmful substances from tobacco smoke, without significantly removing moisture from the smoke and without impairing the enjoyment of smoking.
2. Tobacco smoke filter composition according to advantage/characteristic ("a/c") 1, characterized by the fact that it consists of:

antioxidants consisting of: Ascorbic Acid, Butylparaben, Citric Acid, L-Glutathione, Melatonin, Resveratrol, Selenium and/or its derivatives, Ubiquinones, or Green Tea;

minerals consisting of: activated carbon, clinoptilolite (Zeolite), Cuprous Chloride and Magnetized Ferrite.
3. Tobacco smoke filter, constituted by the composition according to a/c 1, characterized by the fact that it comprises:

means to remove from tobacco smoke free radicals, by a first chamber (3) of the filter, inside which the smoke initially pass through, which is constituted by non absorbent antioxidants;

means to reduce the carcinogenic substances contained in the tobacco smoke, and possible residues of antioxidants, by a second chamber (2) constituted by minerals;

means to separate the two chambers from each other, and possibly also from the external environment, by one (4) or more (5, 6) partitions.
4. Tobacco smoke filter according to a/c 1 and 3, characterized by the fact that it takes a cylindrical shape and comprises the Antioxidants and the minerals contemplated in the present synergist composition that should be, after are through mixed, introduced into the fibrous base filter in two stages, first the antioxidants (3) to be effective as free radical scavenger and than after the minerals (2) will eliminate to a significant extent the carcinogenic substance contained in the tobacco smoke.
5. Tobacco smoke filter according to a/c 1 and 3, characterized by the fact that it consists of a cylindrical tube with the outer layer made of cellulose acetate and with two internal chambers (2, 3), separated from each other by a partition (4) of cellulose acetate made from a fibrous material selected from the group consisting of paper, cellulose acetate, viscose base and other types of plastics and/or metal; said tube may be embodied in a filter type cigarette or in a holder for the cigarette, cigars, or pipe tobacco, which such porosity to permit the passage of smoke through.
6. Invention according to a/c 1 and 3, characterized by the fact that the scope to have antioxidants in a separate chamber is due to the fact that, if the high temperature of the tobacco smoke will melt even a small fraction of the antioxidants, the same will be removed completely by the mineral compound positioned in the second chamber.
7. Invention according to a/c 1 and 3, characterized by the fact that the synergist composition of the antioxidants and minerals, calculated for each filter, should be an amount approximately between 50 to 100 mg., then the homogenized mixture of the composition as radical scavenger and minerals, as adsorbed to remove noxious particles and gases from tobacco smoke, is placed between the filter separated by each other.
8. Invention according to a/c 1 and 3, characterized by the fact that it includes a magnetized active carbon composition, comprising activated carbon and a magnetized ferrite powder mixed therewith, a method for reinforcing activities of active carbon using this magnetized active carbon to prevent damage caused by free radicals and from all other contaminants of tobacco smoke.
9. Invention according to a/c 1, 3 and 8, characterized by the fact that the minerals composition comprising active carbon and a magnetized ferrite mixed therewith, is effectively used for removing free radicals, carbon monoxide, hydrogen and the like from cigarette or tobacco smoke.

10. Invention according to a/c 1, 3, 8 and 9, characterized by the fact that the magnetized active carbon and the other minerals have a capacity to absorb a variety of gaseous components, ranging from those having a relatively low molecular weight to those having a high molecular weight, even when the concentration of these gaseous components is very low and there is humidity.

11. Invention according to a/c 1, 3, 8, 9 and 10, characterized by the fact that the magnetized active carbon has also catalytic effect on sulphurous acid gas, nitrogen oxides, ozone, chlorine and the like.

12. Invention according to a/c 1, 3 and from 8 to 11, characterized by the fact that the activated charcoal has a specific surface area exceeding a million square centimeters per gram, a particle size between 8 to 50 mesh and impregnated with about 1% to 13%, preferably 4% to 6% by weight thereof of a magnetized micro-powdered ferrite in an amount not exceeding about 14% of the weight of the charcoal granules.

13. Invention according to a/c 1, 3 and from 8 to 12, characterized by the fact that magnetized substances such as Ferrite oxide and the like are preferably incorporated in active carbon. In general, there may also be employed magnetized ferromagnetic substances such as ferrite of the inverse-spinel type structure, ferrite of the probeskite structure, ferrite of the illmenite structure, ferrite of the rutile type structure and strontium ferrite.

14. Invention according to a/c 1 or 3, characterized by the fact that the removal of most of the free radicals and other harmful tobacco contaminants, is accomplished by a combination of diffusion, free radicals and other impact, and direct collision of the droplets with the filter compound. Upon collision the droplets are retained on the compound by the surface attraction between the extremely small particles and the relatively large particles of the powdered compound.

15. Invention according to a/c 1 or 3, characterized by the fact that when tobacco smoke passes into the filter, large quantities of tar, nicotine and other noxious substances are absorbed by the filter and will fail to reach the smoker, with the result to significantly reducing the hazards of smoking tobacco, as they reduce its toxicity.

16. Invention according to a/c 1, 2 or 3, characterized by the fact that said Ascorbic Acid is contained in an amount between approximately 0.1 to 60 mgs.

17. Invention according to a/c 1, 2 or 3, wherein said Butylparaben is contained in an amount between approximately 0.01 mgs. to 5 mgs.

18. Invention according to a/c 1, 2 or 3, wherein said Citric Acid is contained in an amount between approximately 0.1 mgs. to 10 mgs.

19. Invention according to a/c 1, 2 or 3, wherein said L-Glutathione is contained in an amount between approximately 0.01 mgs. to 20 mgs.

20. Invention according to a/c 1, 2 or 3, wherein said Melatonin is contained in an amount between approximately 0.1 mgs. to 2 mgs.

21. Invention according to a/c 1, 2 or 3, wherein said Resveratrol is contained in an amount between approximately 0.01 mgs to 2 mgs.

22. Invention according to a/c 1, 2 or 3, wherein said Selenium is contained in an amount between approximately 0.01 mcgs. to 10 mcgs.

23. Invention according to a/c 1, 2 or 3, wherein said Activated Carbon is contained in an amount between approximately 0.1 mgs. to 60 mgs.

24. Invention according to a/c 1, 2 or 3, wherein said Clinoptilolite (Zeolite) is contained in an amount between approximately 0.1 mgs. to 60 mgs.

25. Invention according to a/c 1, 2 or 3, wherein said Cuprous Chloride is contained in an amount between approximately 0.1 mgs. to 15 mgs.

26. Invention according to a/c 1, 2 or 3, wherein said Magnetized Ferrite is contained in an amount between approximately 0.1 mgs. to 30 mgs.

27. Invention according to a/c 1, 2 or 3, wherein said Green Tea is contained in an amount between approximately 0.1 mgs. to 0,15 mgs.

28. Invention according to a/c 19, wherein it further comprises a member selected from L-Glutathione, consisting of Glutathione Peroxidase or Glutathione Reductase.

29. Invention according to a/c 22, wherein it further comprises a member selected from Selenium, consisting L-Selenomethionine or L-Selenocysteine.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A tobacco smoke filter for use with cigarettes, cigars, pipes, cigarette holders or other smoking articles, said filter comprising:

means for removing from tobacco smoke free radicals;

means for reducing carcinogenic substances contained in the tobacco smoke ; and means for separating said means for removing and said means for reducing.

2. The filter of claim 1 wherein said means for removing comprises a chamber having non absorbent antioxidants disposed inside which the smoke initially passes through.

3. The filter of claim 1 wherein said means for reducing is a chamber constituted by minerals.

4. The filter of claim 1 wherein said means for separating is one or more partitions.

5. A tobacco smoke filter for use with cigarettes, cigars, pipes, cigarette holders or other smoking articles, said filter comprising:

a first chamber having non absorbent antioxidants disposed inside which smoke initially passes through for removing tobacco smoke free radicals;

a second chamber constituted by minerals for reducing carcinogenic substances contained in the tobacco smoke; and one or more partition for separating said first chamber from said second chamber.

6. The tobacco smoke filter according to claims 5, wherein said first chamber and said second chamber are generally cylindrical in shape; wherein the antioxidants and the minerals are introduced into their respective chambers to produce two stage filtering, first the antioxidants are effective as free radical scavenger and than the minerals eliminate at least a portion of the carcinogenic substance contained in the tobacco smoke.

7. The tobacco smoke filter according to claims 5, further including a member generally cylindrical in shape and serving as an outer cover layer for the first chamber and the second chamber, said outer cover layer made of cellulose acetate; wherein said one or more partitions constructed of cellulose acetate made from a fibrous material selected from the group consisting essentially of paper, cellulose acetate, viscose base, plastics and metal; wherein a porosity of the tube like member ermits the passage of smoke through.

8. The tobacco smoke filter of claim 1 wherein said antioxidants and said minerals are provided in an amount approximately between 50 to 100 mg.

9. The tobacco smoke filter of claim 5 further comprising a magnetized active carbon composition, comprising activated carbon and a magnetized ferrite powder.

10. The tobacco smoke filter of claim 9 wherein the magnetized active carbon and the minerals absorb a variety of gaseous components.

11. The tobacco smoke filter of claim 9 wherein the magnetized active carbon has also catalytic effect on sulphurous acid gas, nitrogen oxides, ozone and chlorine.

12. The tobacco smoke filter of claim 9 wherein the activated carbon is an activated charcoal having a specific surface area exceeding a million square centimetres per gram, a particle size between 8 to 50 mesh and impregnated with about 1% to 13% by weight thereof of a magnetized micro-powdered ferrite in an amount not exceeding about 14% of the weight of the charcoal granules.

13. The tobacco smoke filter of claim 1 wherein when tobacco smoke passes into the first chamber and the second chamber, quantities of tar, nicotine and other noxious substances are absorbed and will fail to reach the smoker, with the result of reducing the hazards of smoking tobacco as toxicity is reduced.

14. The tobacco smoke filter of claim 5 wherein the antioxidants comprises at least ascorbic acid in an amount between approximately 0.1 to 60 mgs.

15. The tobacco smoke filter of claim 5 wherein the antioxidants comprises at least butylparaben in an amount between approximately 0.01 mgs. to 5 mgs.

16. The tobacco smoke filter of claim 5 wherein the antioxidants comprises at least citric acid in an amount between approximately 0.1 mgs. to 10 mgs.

17. The tobacco smoke filter of claim 5 wherein the antioxidants comprises at least 1-glutathione in an amount between approximately 0.01 mgs. to 20 mgs.

18. The tobacco smoke filter of claim 5 wherein the antioxidants comprises at least melatonin in an amount between approximately 0.1 mgs. to 2 mgs.

19. The tobacco smoke filter of claim 5 wherein the antioxidants comprises at least resveratrol in an amount between approximately 0.01 mgs to 2 mgs.

20. The tobacco smoke filter of claim 5 wherein the antioxidants comprises at least selenium in an amount between approximately 0.01 mcgs. to 10 mcgs.

21. The tobacco smoke filter of claim 5 wherein the minerals comprises at least activated carbon in an amount between approximately 0.1 mgs. to 60 mgs.

22. The tobacco smoke filter of claim 5 wherein the minerals comprises at least clinoptilolite (zeolite) in an amount between approximately 0.1 mgs. to 60 mgs.

23. The tobacco smoke filter of claim 5 wherein the minerals comprises at least cuprous chloride in an amount between approximately 0.1 mgs. to 15 mgs.

24. The tobacco smoke filter of claim 5 wherein the minerals comprises at least magnetized ferrite in an amount between approximately 0.1 mgs. to 30 mgs.

25. The tobacco smoke filter of claim 5 wherein the antioxidants comprises at least green tea in an amount between approximately 0.1 mgs. to 0,15 mgs.

26. The tobacco smoke filter of claim 5 wherein the antioxidants comprises at least a member selected from 1-glutathione, consisting essentially of glutathione peroxidase or glutathione reductase.

27. The tobacco smoke filter of claim 5 wherein the antioxidants comprises at least a member selected from selenium, consisting essentially of 1-selenomethionine or 1-selenocysteine.

* * * * *